United States Patent [19]

Lawrence

[11] Patent Number: 4,514,032

[45] Date of Patent: Apr. 30, 1985

[54] CONTACT ELEMENT

[75] Inventor: George J. Lawrence, Mechanicsburg, Pa.

[73] Assignee: AMP Incorporated, Harrisburg, Pa.

[21] Appl. No.: 547,186

[22] Filed: Oct. 31, 1983

[51] Int. Cl.[3] ..... H01R 3/00; H01R 13/50

[52] U.S. Cl. ..... 339/278 C; 339/176 MP

[58] Field of Search ..... 339/278 C, 176 MP

[56] References Cited

U.S. PATENT DOCUMENTS

| | | | |
|---|---|---|---|
| 2,294,482 | 9/1942 | Siegmund | 339/278 C |
| 2,966,652 | 12/1960 | Parstorfer | 339/220 R |
| 3,152,853 | 10/1964 | Scott | 339/220 R |
| 3,335,398 | 8/1967 | Clewes | 339/217 S |
| 3,496,520 | 2/1970 | Reynolds | 339/278 C |
| 3,585,573 | 6/1971 | Robshaw | 339/278 C |
| 3,951,497 | 4/1976 | Balzano | 339/278 C |
| 4,043,893 | 8/1977 | Gelfand | 339/278 C |

*Primary Examiner*—Joseph H. McGlynn
*Assistant Examiner*—Gary F. Paumen
*Attorney, Agent, or Firm*—Allan B. Osborne

[57] ABSTRACT

The present invention relates to contact surfaces on contact elements such as found in card edge connectors and the like. More particularly, the invention teaches a clip slideably mounted on the upper end of a contact element and providing a fixed, tin to tin contact area between the trace on a circuit card and the clip and a gold to gold sliding contact area between the clip and the contact element.

4 Claims, 6 Drawing Figures

Fig. 1
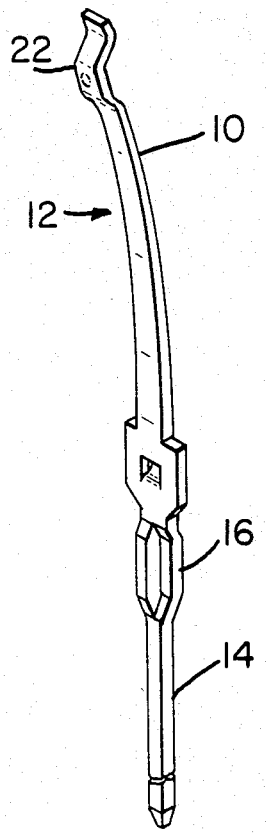
Fig. 2
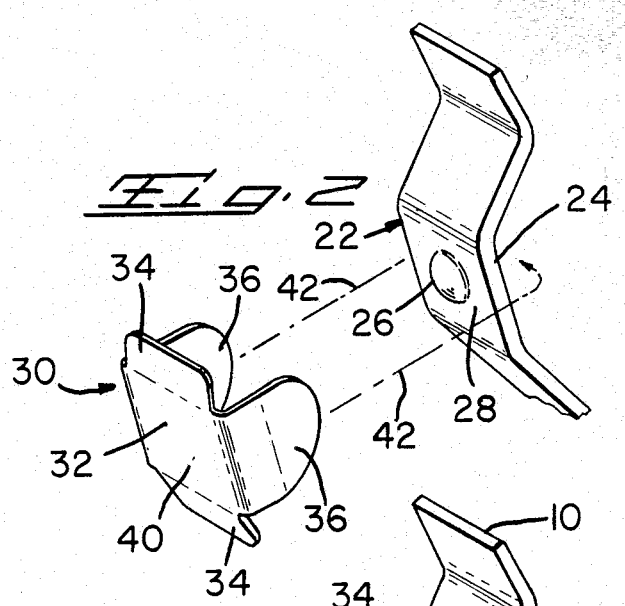
Fig. 3
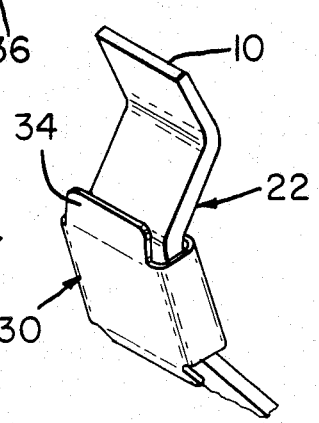
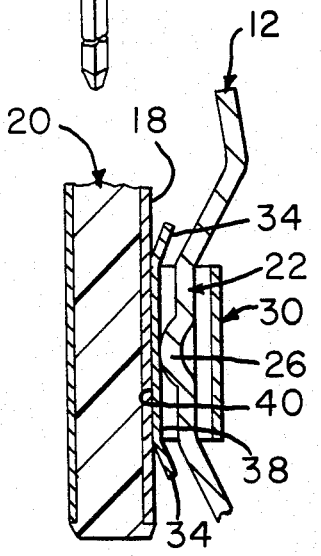
Fig. 4
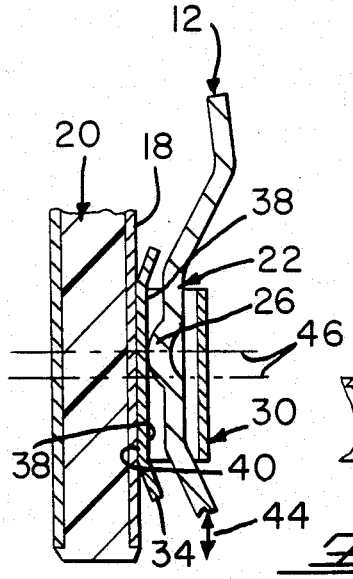
Fig. 5
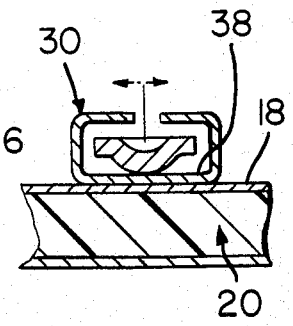
Fig. 6

CONTACT ELEMENT

BACKGROUND OF THE INVENTION

1. Field of the Invention

The invention disclosed herein relates to the surface on a contact element such as found in card edge connectors which make electrical contact with the conductive trace or pad on a circuit card inserted in the connector.

2. Prior Art

Contemporary contact elements are formed to provide a convex surface adjacent the upper free end. U.S. Pat. Nos. 3,665,370, 4,077,688 and 4,303,294 disclose such contact elements. The convex surface is plated with gold as is the trace on the circuit card against which the convex surface abutts. The gold plating provides a tough surface capable of withstanding sliding motion between the two abutting surfaces. Less noble plating; e.g., tin, wears away quickly under sliding motion, including such motion induced by thermal expansion and contraction, and the resulting fretting corrosion causes reduced electrical contact between the abutting surfaces. Accordingly, such plating, although less expensive and having adequate electrical properties, have been relegated to stationary contacts which are preferably under substantial compression to prevent movement. U.S. Pat. No. 3,853,382 discloses one such successful application of non-noble plating.

SUMMARY OF THE INVENTIONS

The invention disclosed herein combines the advantages of tin to tin and gold to gold contacting surfaces by providing a clip slidingly mounted on a contact element. One surface of the clip is plated with tin and is adapted to non-movably abutt a tin plated conductive trace on a circuit card or the like. Another surface of the clip is plated with gold and is adapted to abutt a sliding gold plated surface on the contact element.

BRIEF DESCRIPTION OF THE DRAWINGS

FIG. 1 is an isometric view of a contact element formed to provide a section onto which the clip of the present invention is slidingly positioned;

FIG. 2 is an isometric view of the clip of the present invention and the aforementioned contact element section before the clip is attached thereto;

FIG. 3 is an isometric view of the clip attached to the section;

FIGS. 4 and 5 are cross-sectional views showing the contact element with the attached clip and a circuit card and illustrating stationary and sliding modes; and FIG. 6 is a cross-sectional view looking into the clip and enclosed section to illustrate lateral movement obtainable by the present invention.

DESCRIPTION OF THE INVENTION

Except for upper end 10, the contact element 12 shown in the several figures is typical, having a wire wrap post 14 at the lower end and a compliant section 16 which is received in a plated thru hole in a printed circuit board (not shown). The contact element is fixed in a housing (not shown) to form a card edge connector (not shown) having a card edge receiving slot. As is well known, the upper end 10 of a contemporary contact element includes a convex surface which engages a conductive trace 18 on circuit card 20 (FIGS. 4–6). As is also well known, optimum contact is obtained if the contact surface wipes the trace surface as it is being positioned there against. Such wiping requires that the surfaces be plated with a noble metal; e.g., gold. The cost of such plating, particularly on the card traces, is substantial. If even just the traces can be plated with tin or other non-noble material, substantial savings would result. The present invention provides that opportunity.

In order to practice the present invention a section on upper end 10 of contact element 12 must be provided. This section, indicated by reference numeral 22, may be described as being a jog having a flat portion 24. A boss 26 is provided on the convex surface 28 thereof which faces the card slot when the contact element is fixed in the connector housing. Boss 26 is preferably plated with gold.

Clip 30, constructed in accordance with the present invention, is preferably stamped and formed from copper alloy. From a center plate 32, short ears 34 extend obliquely from each end and flaps 36 extend from each side. The inner surface 38 (FIGS. 4–6) of plate 32 is plated with gold and outer surface 40 (FIG. 2) is plated with tin. The clip is fastened to section 22 by wrapping flaps there around as indicated by the dashed arrows 42 in FIG. 2. Gold plated inner surface 38 faces gold plated boss 26. The clip is loosely attached so that a degree of independent movement is available. FIG. 3 shows the clip properly attached to section 22 of the contact element.

FIGS. 4, 5 and 6 illustrate the operation of the present invention. Those figures show the clip on a contact element in abutting engagement with conductive trace 18 on circuit card 20. The element is forced against the card either by being preloaded in the housing, see for example U.S. Pat. No. 4,077,694, or by camming means in a zero insertion force (ZIF) connector such as taught in U.S. Pat. No. 4,288,139. The compressive force urges tin plated outer surface 40 hard against trace 18 which can be now advantageously plated with tin. Further, the boss 26 bears hard against gold plated inner surface 38. FIG. 5 shows the contact element and more particularly boss 26, being moved by the camming action of a zero insertion force connector. The boss slides up and down on the inner surface 38 as indicated by arrow 44. The wiping action occurs over the distance indicated by dashed lines 46. The compressional and frictional forces hold the clip stationary against trace 18 so that no wearing or erosion can occur.

FIGS. 4 and 5 additionally show that ears 34, being turned in, provides a smooth surface so as not to tear trace 18.

FIG. 6 illustrates that lateral movement is available to the contact element without clip 30 moving. The clip is attached to section 22 to provide that degree of freedom.

In lieu of gold or other noble plating, metal inlaying may be used to good advantage.

The present invention may be subject to many modifications and changes without departing from the spirit or essential characteristics thereof. The present embodiment is therefore intended in all respects as being illustrative and not restrictive of the scope of the invention.

I claim:

1. An improved contact element for card edge connectors of the type having a card slot for receiving a circuit card and contact elements on each side of the card slot for interconnecting circuits on a circuit card located in the slot to circuits on a circuit board on which the connector may be mounted, said improved contact element comprising:

a. retaining means for being received in the connector and for retaining the element therein;

b. depending means attached to a lower end of the retaining means and for being attached to circuits on a circuit board on which the connector may be mounted;

c. an elongated cantilever beam attached to the retaining means and extending upwardly alongside a card slot in the connector, said beam having a flat section located near a free end of the beam;

d. a noble-metal plated, convex surface located on the flat section and facing towards the card slot; and e. a clip having a center plate with an outer surface being plated with a non-noble metal and an inner surface being plated with a noble metal and attaching means for slidingly attaching the clip to the flat section on the beam with the inner surface bearing against the convex surface and the outer surface facing the card slot for engagement with a circuit card which may be positioned therein.

2. The improved contact element of claim 1 wherein the flat section on the beam is on a jog in the beam and is displaced laterally towards the card slot.

3. The improved contact element of claim 2 wherein the attachment means on the clip include a flap on each side of the center plate and which are wrapped around the flat section.

4. The improved contact element of claim 3 further including short ears on each end of the center plate and which extend towards the beam at a slant relative to the center plate.

* * * * *